US007686470B2

(12) United States Patent
Chiang

(10) Patent No.: US 7,686,470 B2
(45) Date of Patent: Mar. 30, 2010

(54) CEILING LIGHT FIXTURE ADAPTABLE TO VARIOUS LAMP ASSEMBLIES

(75) Inventor: Wen-Chiang Chiang, San Chong (TW)

(73) Assignee: Valens Company Limited, Taipei county (TW)

( * ) Notice: Subject to any disclaimer, the term of this patent is extended or adjusted under 35 U.S.C. 154(b) by 201 days.

(21) Appl. No.: 11/967,279

(22) Filed: Dec. 31, 2007

(65) Prior Publication Data

US 2009/0168439 A1 Jul. 2, 2009

(51) Int. Cl.
*F21S 8/00* (2006.01)
*F21S 19/00* (2006.01)
*F21S 4/00* (2006.01)
*F21V 21/00* (2006.01)

(52) U.S. Cl. ..... 362/147; 362/217.1; 362/218; 362/229; 362/249.02

(58) Field of Classification Search ..... 362/223, 362/404, 147, 148, 221, 217.1, 217.11, 217.12, 362/228, 229, 268, 362, 364, 396, 249.02, 362/218
See application file for complete search history.

(56) References Cited

U.S. PATENT DOCUMENTS 2,318,716 A * 5/1943 Rolph ..... 362/223
5,152,601 A * 10/1992 Ferng ..... 362/183
6,092,913 A * 7/2000 Edwards, Jr. ..... 362/260
7,252,409 B2 * 8/2007 Kim ..... 362/294
7,435,106 B2 * 10/2008 Su et al. ..... 439/76.1
7,478,924 B2 * 1/2009 Robertson ..... 362/240
2006/0152921 A1 * 7/2006 Welker ..... 362/147

* cited by examiner

*Primary Examiner*—Jong-Suk (James) Lee
*Assistant Examiner*—David R Crowe
(74) *Attorney, Agent, or Firm*—Leong C. Lei

(57) ABSTRACT

A ceiling light fixture includes a housing forming a channel having a trapezoidal cross section and a light-transmitting cover panel fixed in and covering the channel. The channel has a bottom wall forming a slot. A circumferential mounting frame is formed on a back of the bottom wall of the channel and barbs extend from the mounting frame. The bottom wall further forms a fitting hole. The ceiling light fixture selectively receives a first lamp assembly in the mounting frame and secures the lamp assembly with the barbs so that a light source of the lamp assembly is exposed through the slot for irradiating light or alternatively an end seat of a lamp tube is fit and retained in the fitting hole to set and fix the lamp tube in the slot to realize interchangeable use of the ceiling light fixture with different lamp assemblies.

4 Claims, 10 Drawing Sheets

CEILING LIGHT FIXTURE ADAPTABLE TO VARIOUS LAMP ASSEMBLIES

BACKGROUND OF THE INVENTION (a) Technical Field of the Invention

The present invention relates to a ceiling light fixture that is adaptable to various lamp assemblies without modification of structure thereof so that discarding an original but still workable light fixture in the course of replacing the traditional more power-consuming light sources with a newly-developed, less power-consuming light source is not necessary and the amount of waste caused by discarding the original light fixture is substantially reduced.

(b) Description of the Prior Art

The world is now in the beginning of the twenty-first century and people are now more aware of the fragile and delicate balance between the amount of energy consumed and the global weather than those living in the years of industrial revolution and the modern realizes that the Earth will die and become hostile to life forms very soon due to depletion of resources and deterioration of ecological environment if low energy consuming technology is not immediately taken in all respects of the human society to overcome all sorts of problems caused by the current energy-consuming based living model. One of the major factors that consume a great amount of energy and cause significant change to the Earth weather is electricity based lighting. Most of the electrical power consumed today is obtained from fossil energy and a minor port of the electrical power is obtained otherwise. In generating light to light up the housing and surroundings, heat is also caused and dissipated to the surroundings. The total amount of heat generated by lighting is very huge. This is even worse for the traditional lighting technology, for they do not have a high efficiency conversion between electricity and light and need to consume more electricity to give the same level of brightness. This is generally a waste of energy and a source of heat leading to warming of the world. Thus, a lot of countries of the world set limitation on the use of high power-consuming lighting devices and encourage replacement of the traditional high power-consuming lighting devices with newly-developed less power consuming light sources with an attempt to alleviate the damage caused the lighting that is required for daily living of human society.

The high efficiency, less power-consuming light source developed by the modern technology is generally set toward using electronic lighting device that is powered by low-voltage electronic circuits to meet the regular needs of daily lighting. One of the most mature technologies available nowadays is brightness-enhanced light-emitting diode (LED), which now gradually replace the traditional lamp bulb of traffic lights and is also getting available for household lighting. On the other hand, as compared to the incandescent lamps, even in the early age, a fluorescent lamp tube is considered a less power-consuming lighting device. The fluorescent lamp, although having problems of pollution due to the fluorescent agent contained therein and other problems, such as that a broken lamp tube usually has a sharp edge that might cut human body, is still widely used in many areas and countries due to less consumption of power. However, with the sever warming of the Earth and the gradual depletion of natural resources, completely using the light-emitting diode base light source to replace all sorts of traditional light source, including both incandescent bulb and fluorescent tube is no way of escape.

With such a trend of completely replacing the fluorescent tube with the light-emitting diode, the traditional ceiling mounted light fixtures that are only adaptable to the traditional light sources must be discarded totally. This produces a great amount of garbage and is also a waste. Thus, under this trend, a ceiling mounted light fixture, such as one that is commonly used in for example offices, must be of a design that allow for use with both the traditional light source, such as the fluorescent tube, and the newly-developed electronic light source, such as light-emitting diodes, so that during the transition from the fluorescent tube to the light-emitting diode, no immediate and complete replacement of the original light fixture is needed and the garbage so produced is eliminated.

In view of the above discussion, the present inventor has devoted himself to the development of such a novel ceiling light fixture that is adaptable to various light sources in order to overcome the problems induced during the transition from the traditional light source to the newly-developed light sources.

SUMMARY OF THE INVENTION

The primary purpose of the present invention is to provide a ceiling light fixture adapted to interchangeably use with various lamp assemblies, comprising a base housing forming at least one elongated channel having a trapezoidal cross section and light-transmitting cover panel corresponding to each elongated channel and having edge plates forming tenon fitting structures for closing an opening of the channel. Each trapezoidal-cross-section channel has a bottom wall forming an elongate slot. The bottom wall of the trapezoidal-cross-section elongated channel that forms the elongate slot forms on a back side thereof a circumferential raised mounting frame and a plurality of barbs extending from the mounting frame. The bottom wall of the trapezoidal-cross-section elongated channel further forms in each lengthwise end with respect to the elongate slot a lamp tube end seat fitting hole. Thus, the ceiling light fixture selectively allows a first, electronic light source based lamp assembly carrier board to be removably received in the mounting frame and clamped and secured by the barbs to have the electronic light source exposed through the elongate slot for irradiating light toward side walls of the trapezoidal-cross-section elongated channel and the light-transmitting cover panel and or alternatively allows a lamp tube end seat to be fit and retained in the lamp tube end seat fitting hole to set and fix a lamp tube of a second lamp assembly in the elongate slot to realize interchangeable use of the ceiling light fixture with different lamp assemblies. In this way, there is no need to discard the original light fixture in adapting different, new light sources and the amount of waste produced by discarding the original, but still workable, light fixture can be substantially reduced.

Most of companies or organizations are operated in such a way that they keep a stock of consuming parts of office facilities, such as fluorescent lamp tubes or lamp bulbs, and this allows for efficient repairing of a malfunctioning lamp or light due to a broken lamp tube or bulb. Thus, even legislation prohibits future use and sales or importation of the traditional fluorescent lamp tubes, those lamp tube that are already in the stock of these companies or organizations cannot immediately replaced by electronic light sources. Such a replacement can only be done in a gradual, step-by-step process in a very long course of time. The present invention provides a light fixture that offers advantages that both the traditional fluorescent lamp tubes and the newly-developed electronic light sources, such as a light-emitting diode base light source to be adapted thereto. Thus, a smooth transition from the traditional light source to the novel light source can be realized in the evolution of lighting. Concern about the extreme engineering work of simultaneously replacing the traditional light source with the novel light source is eliminated and any impact to the environmentally protective lighting policy can be minimized.

The foregoing object and summary provide only a brief introduction to the present invention. To fully appreciate these and other objects of the present invention as well as the invention itself all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
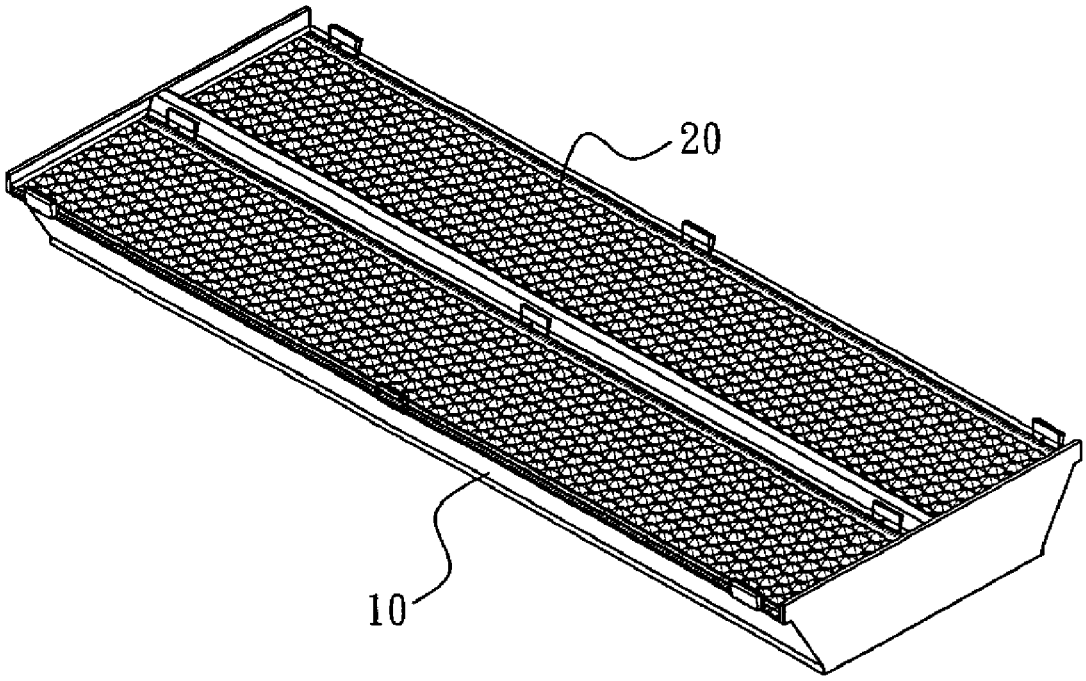
FIG. 1 shows a perspective view of a ceiling light fixture constructed in accordance with the present invention.

FIG. 1 shows a perspective view of a ceiling light fixture constructed in accordance with the present invention. The ceiling light fixture, as shown, has an exterior appearance that looks similar to one of the currently available ceiling light fixture. However, the ceiling light fixture of the present invention has a distinct interior structure, as particularly illustrated in FIG. 2, which shows an exploded view of the ceiling light fixture of the present invention, FIG. 3, which also shows an exploded view of the ceiling light fixture, but from a different perspective, and FIG. 4, which shows a cross-sectional view of the ceiling light fixture in an assembled form. The ceiling light fixture of the present invention comprises a rectangular base housing 10 forming therein at least one elongated channels 11, 12 having a trapezoidal cross-section and a light-transmitting cover panel 20 that has a structure consisting edge plates carrying tenon fittings for covering each channel opening 11A, 12A. It is noted that there are only two trapezoidal-cross-section channels 11, 12 are included in the ceiling light fixture shown in FIGS. 1 and 2, but three such channels are included in the ceiling light fixture shown in FIG. 3. It is also noted although difference in the number of trapezoidal-cross-section channels is present between FIGS. 1, 2 and FIG. 3, the arrangement of repeating the channel is exactly the same. As shown in the drawings, the edge plate tenon fitting structure of the light-transmitting cover panel 20 comprises outside-barbed retention bars 21, 22, which are formed on the edge plates of the cover panel 20 at locations vertically corresponding to fitting holes 11C, 12C formed in a connection wall 11B, 12B arranged between the channel openings 11A, 12A that are adjacent to each other in order to fit into the fitting holes 11C, 12C. With the outside-barbed retention bars 21, 22 fit into the corresponding fitting holes 11C, 12C, the cover panels 20 are positioned and retained on and cover the channel openings 11A, 12A, respectively. The cover panel 20 also forms in a surface thereof, at locations close to and spaced from side edges thereof a predetermined distance, through holes 23, 24. The channel opening 11A, 12A is provided, in side lips thereof, with locking holes 11D, 12D at locations corresponding to the through holes 23, 24 whereby bolts or screws are allowed to extend through the through holes 23, 24 for engaging and being tightened to the locking holes 11D, 12D to tightly secure the cover panel 20 to the channel opening 11A, 12A.

The cover panel 20 forms, on a surface thereof facing the trapezoidal-cross-section channel 11, 12, straight light-splitting racks 25 on opposite edge sections thereof, and also forms, on a central major area thereof, light-deflecting grid cells 26, 27, each being inward concaved. The trapezoidal-cross-section elongated channel 11, 12 has opposite sloped side walls each forming light-reflecting grid cells 11E, 12E, each being convex toward the interior of the channel to enhance the effect of light transmission and light diffraction.

Figure 2:
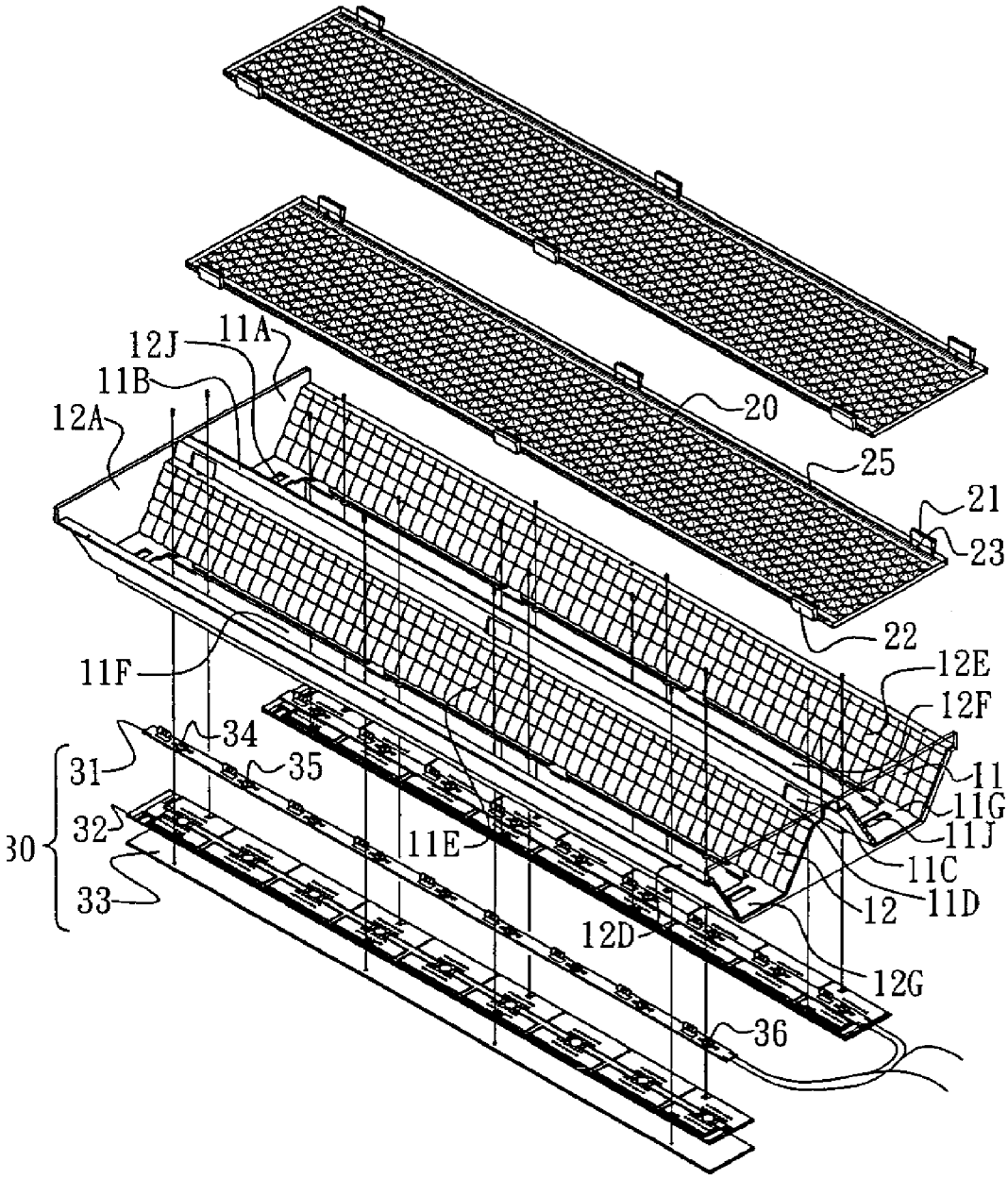
FIG. 2 shows an exploded view of the ceiling light fixture of the present invention taken from a front perspective.
Figure 3:
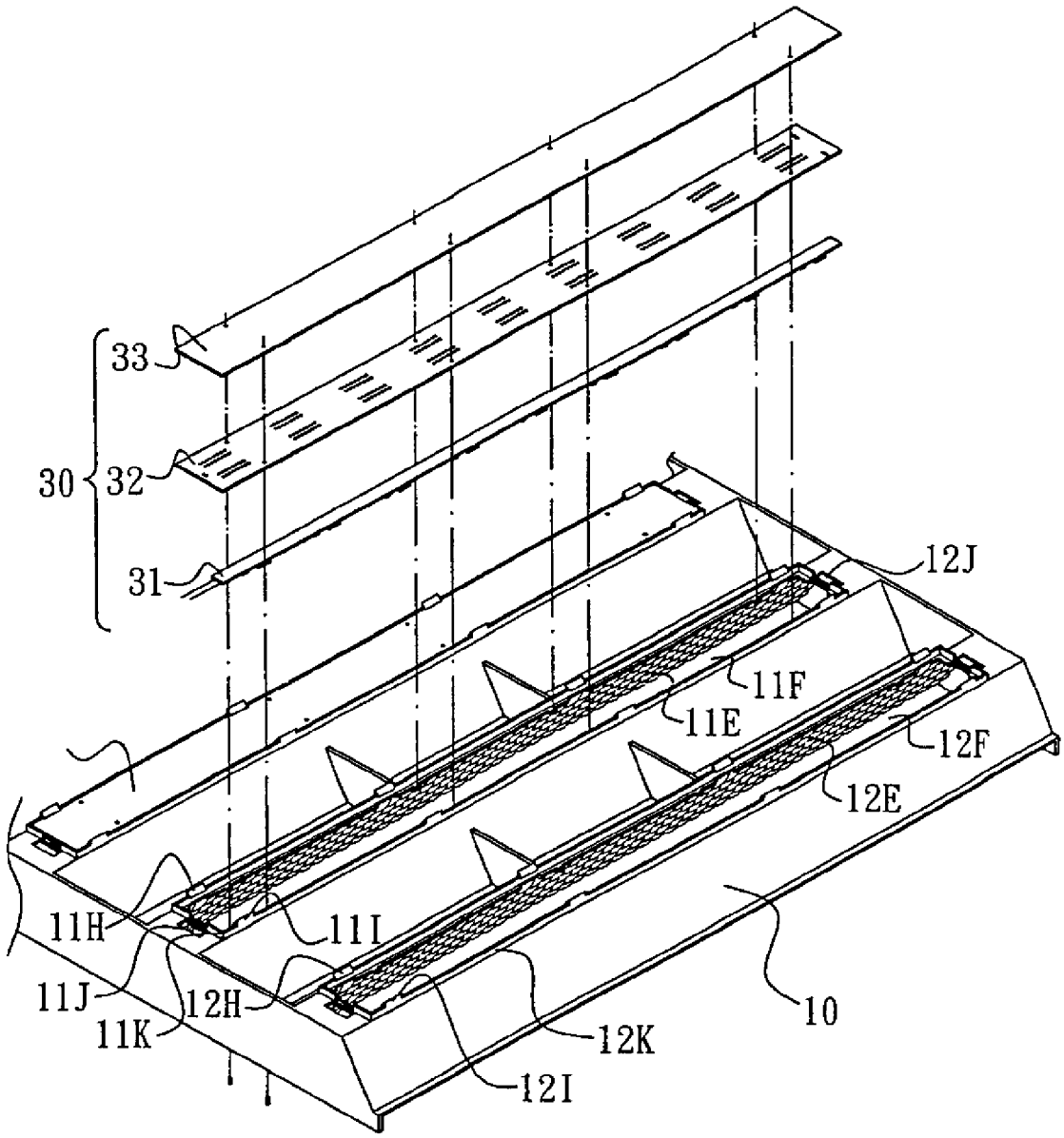
FIG. 3 shows an exploded view of the ceiling light fixture of the present invention taken from a back perspective.
Figure 4:
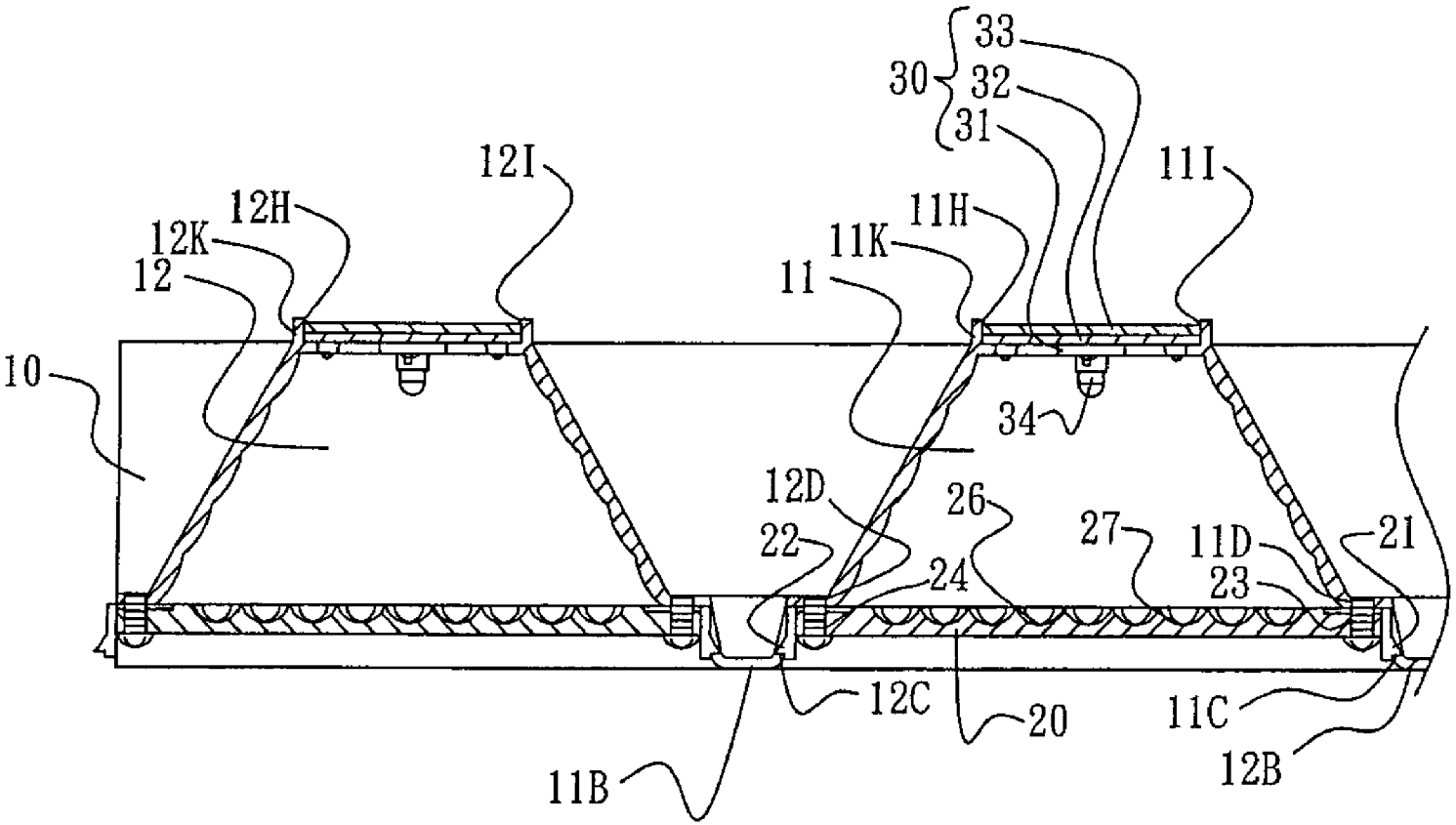
FIG. 4 shows a cross-sectional view of the ceiling light fixture in an assembled form.

Further, the trapezoidal-cross-section elongated channel 11, 12 has a bottom wall 11G, 12G in which an elongate slot 11F, 12F is formed. The bottom wall 11G, 112G of the trapezoidal-cross-section elongated channel 11, 12 that forms the elongate slot 11F, 12F forms, on a back side thereof, a circumferential raised mounting frame 11K, 12K. The mounting frame 11K, 12K comprises a plurality of barbs 11H, 11I, 12H, 12I extending from suitable locations on a top of the mounting frame 11K, 12K. The bottom wall 11G, 12G of the trapezoidal-cross-section elongated channel 11, 12 forms, at a suitable location on each lengthwise end with respect to the elongate slot 11F, 12F, a lamp tube end seat fitting hole 11J, 12J. Thus, an electronic light source based lamp assembly carrier board 30 is allowed to locate in the mounting frame 11K, 12K with the barbs 11H, 11I, 12H, 12I clamping the lamp assembly carrier board 30 to have the electronic light source exposed through the elongate slot 11F, 12F for irradiating light toward the side walls of the trapezoidal-cross-section elongated channel 11, 12 and the light-transmitting cover panel 20. As shown in FIGS. 2, 3, and 4, the lamp assembly carrier board 30 comprises a rectification circuit board 31 having a surface on which a plurality of light-emitting diodes 34, 35, 36 is disposed to serve as the electronic light source, a parallel-connection wiring board 32 having a surface forming connection between contacts of the rectification circuit board 31 and external wirings, and a heat dissipation board 33 that physically engages a back side of the parallel-connection wiring board 32, which are stacked over and bonded to each other. A surface of the heat dissipation board 33 that is opposite to the one stacking over the parallel-connection wiring board 32 is clamped by the barbs 11H, 11I, 12H, 12I for fixing.

Figure 5:
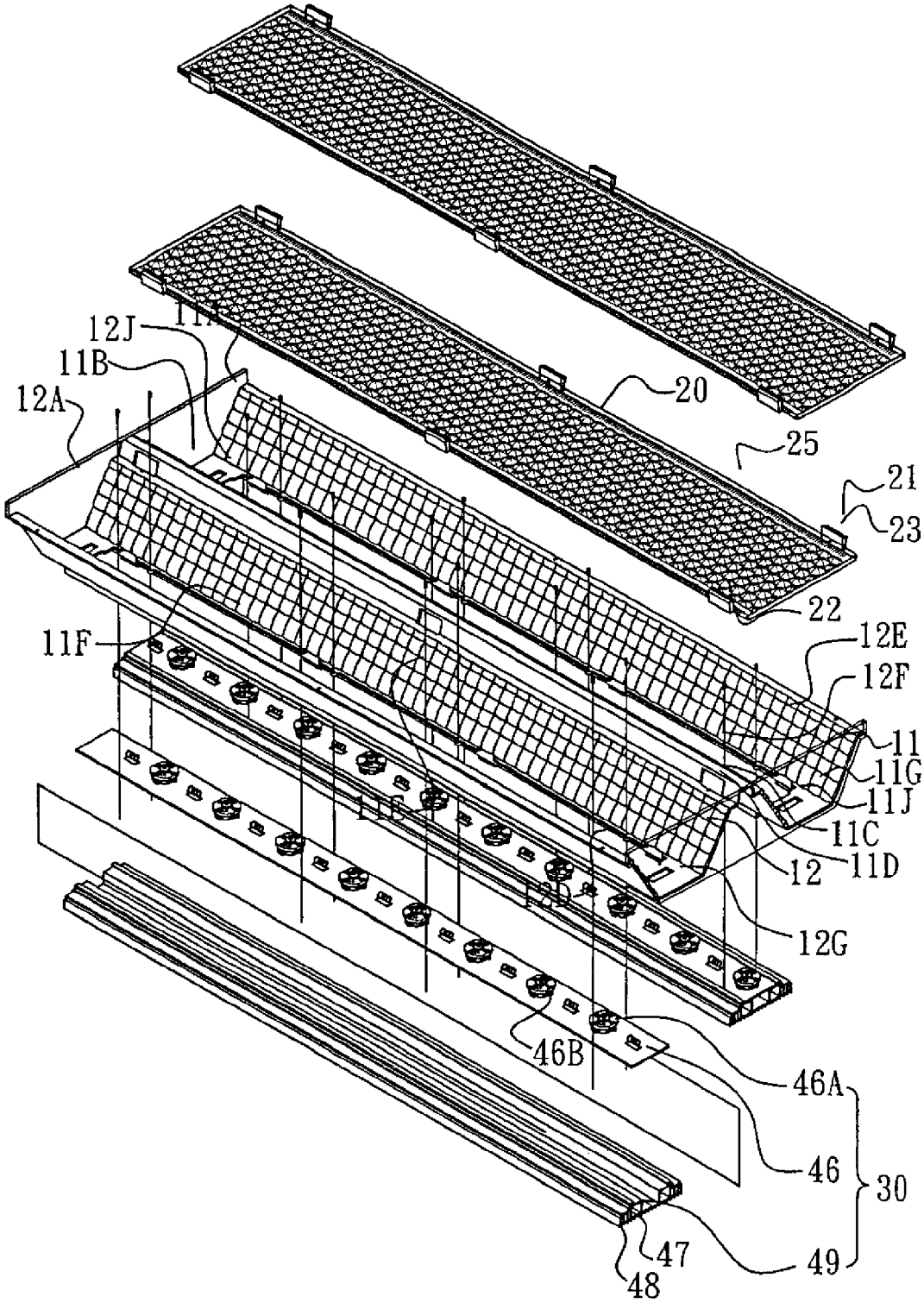
FIG. 5 shows an exploded view of the ceiling light fixture in accordance with the present invention carrying a lamp assembly carrier board of a different type.
Figure 6:
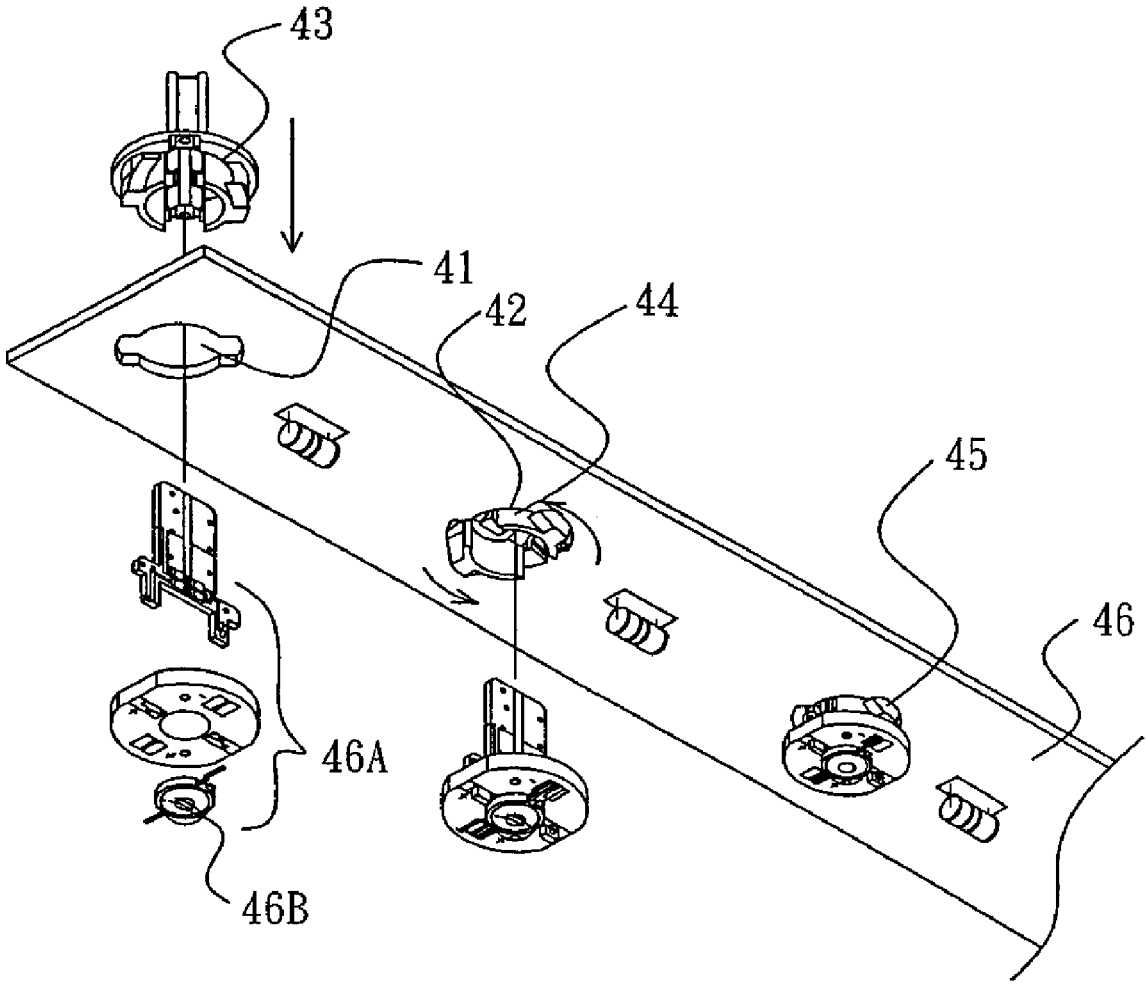
FIG. 6 shows an exploded view of the lamp assembly carrier board of FIG. 5.
Figure 7:
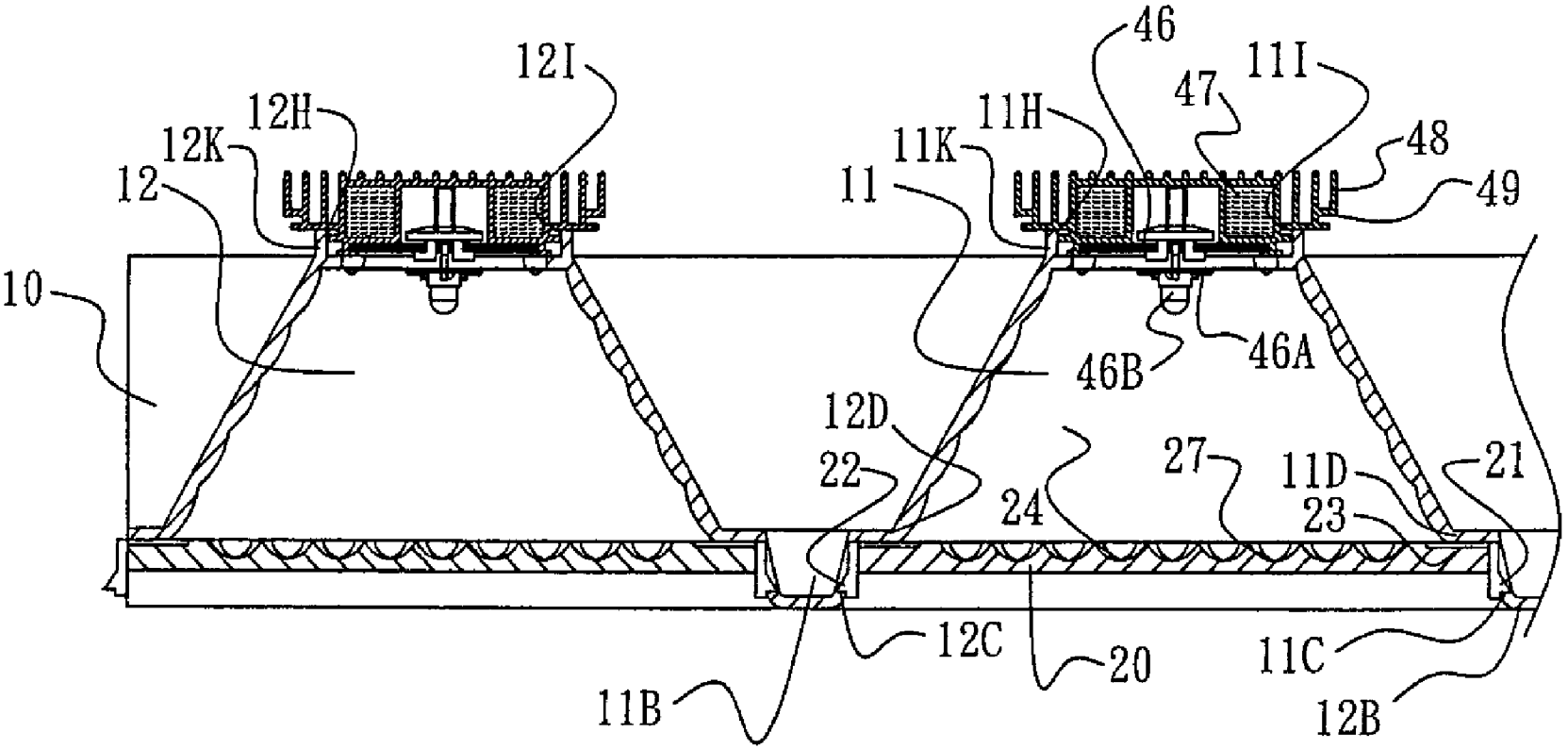
FIG. 7 shows a cross-sectional view of the ceiling light fixture in an assembled form carrying the lamp assembly carrier board of said different type.

Alternatively, as shown in FIG. 5, which illustrates an exploded view of the ceiling light fixture in accordance with the present invention carrying a lamp assembly carrier board of a different type, FIG. 6, which illustrates an exploded view of the lamp assembly carrier board of said different type, and FIG. 7, which illustrates a cross-sectional view of the ceiling light fixture in an assembled form, the lamp assembly carrier board of said different type, which is also designated with reference numeral 30 for simplicity, comprises a parallel-connection wiring board 46 having a surface forming bores 41, 42 for respectively receiving and fixing therein a number of twisting type sockets 43, 44, 45 in a rotatably fitting manner, light-source and rectification circuit board assemblies 46A, which are of the same number as the twisting type sockets 43, 44, 45 and are of a T-shape formed by fitting and soldering separate vertical and horizontal plates together, and a heat dissipation board 49, which forms therein coolant passages 47 and comprises a plurality of heat dissipation fins 48 arranged on a board back thereof, those components being stacked over each other. The light-source and rectification circuit board assembly 46A forms, on a tip of the vertical plate thereof, electrical conduction faces corresponding to electrical contacts of and fitting into the twisting type socket 43, 44, 45, and is provided, on the horizontal plate that is exposed outside the socket with a light-emitting diode 46B to serve as the electronic light source. Opposite flanges of the heat dissipation board 49, which extend laterally and are positioned on the parallel-connection wiring board 46, are clamped by the barbs 11H, 11I, 12H, 12I for fixing.

Figure 8:
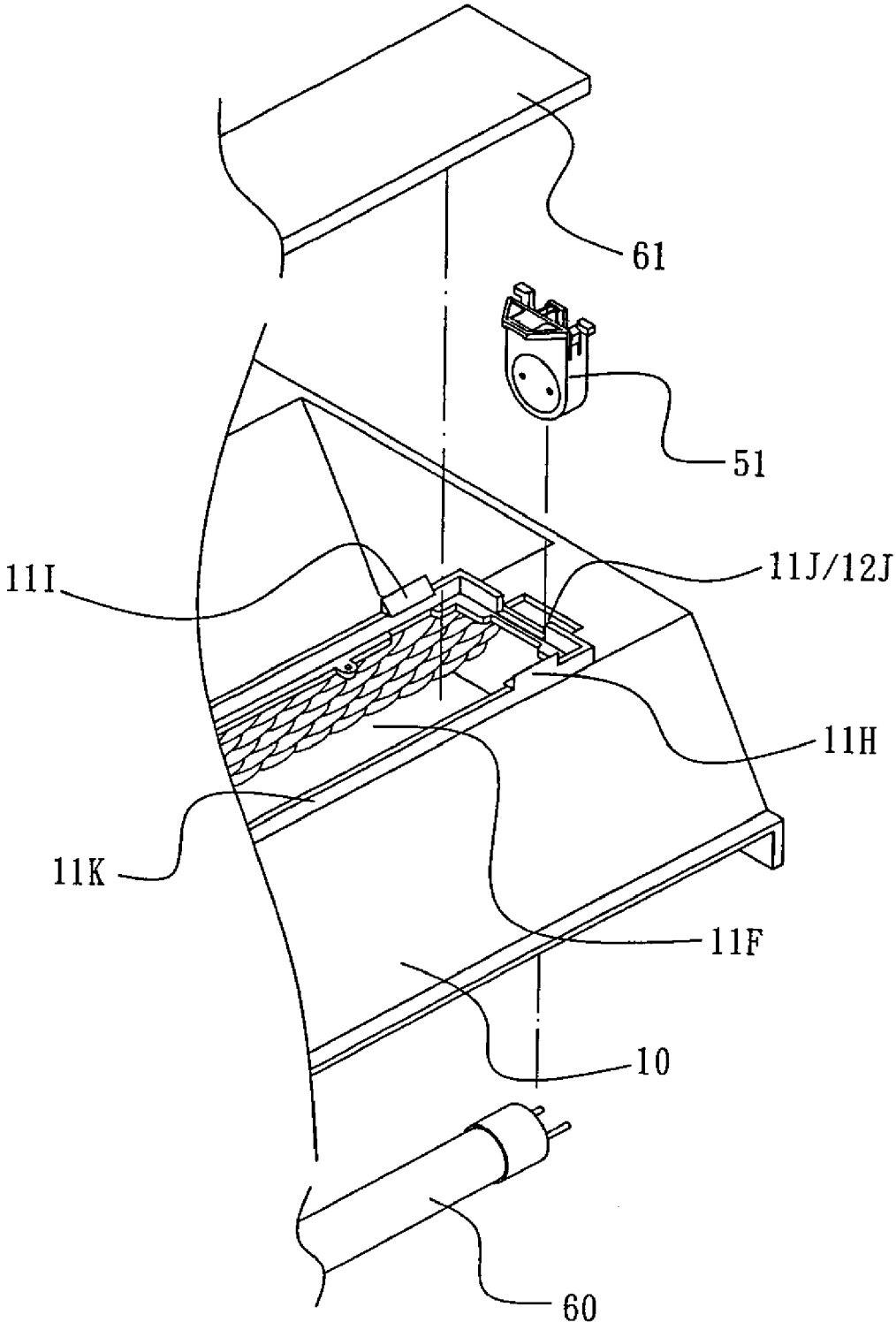
FIG. 8 shows an exploded view, taken from a back perspective, of a portion of the ceiling light fixture in accordance with the present invention carrying a lamp assembly carrier board of a further different type.

Or alternatively, as shown in FIG. 8, which illustrates, from a back perspective, an exploded view of a portion of the ceiling light fixture in accordance with the present invention carrying a lamp assembly carrier board of a timer different type, a lamp tube end seat 51 of the lamp assembly of said further different type is fit in and retained by the lamp tube end seat fitting hole 11J, 12J so that a lamp tube 60 of the lamp assembly can be fixed in the elongate slot 11F, 12F. Further, a reflector plate 61 of a suitable size is fit in the mounting frame 11K with a back side of the reflector plate 61 clamped and fixed by the barbs 11H, 11I, 12H, 12I to thereby close the elongate slot 11F so as to prevent light emitted from the lamp tube 60 from leaking backward through the elongate slot 11F and thus prevent reduction of brightness. The present invention allows the lamp assembly to be interchangeably switched and to replace the lamp assembly with a light-emitting diode based light source, the reflector plate 61 is first removed from the mounting frame 11K to open the elongate slot 11F so that interference with mounting of the light-emitting diode based light source that is described previously can be overcome.

Figure 9:
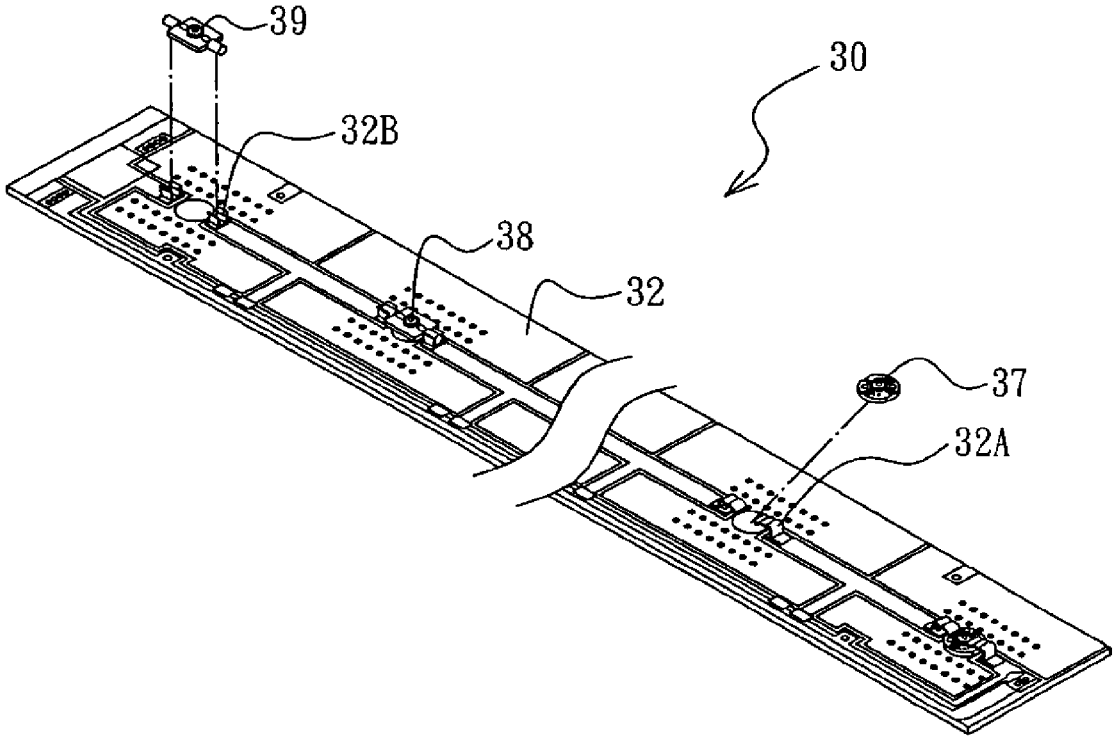
FIG. 9 shows a perspective view of a lamp assembly carrier board of yet a further different type.
Figure 10:
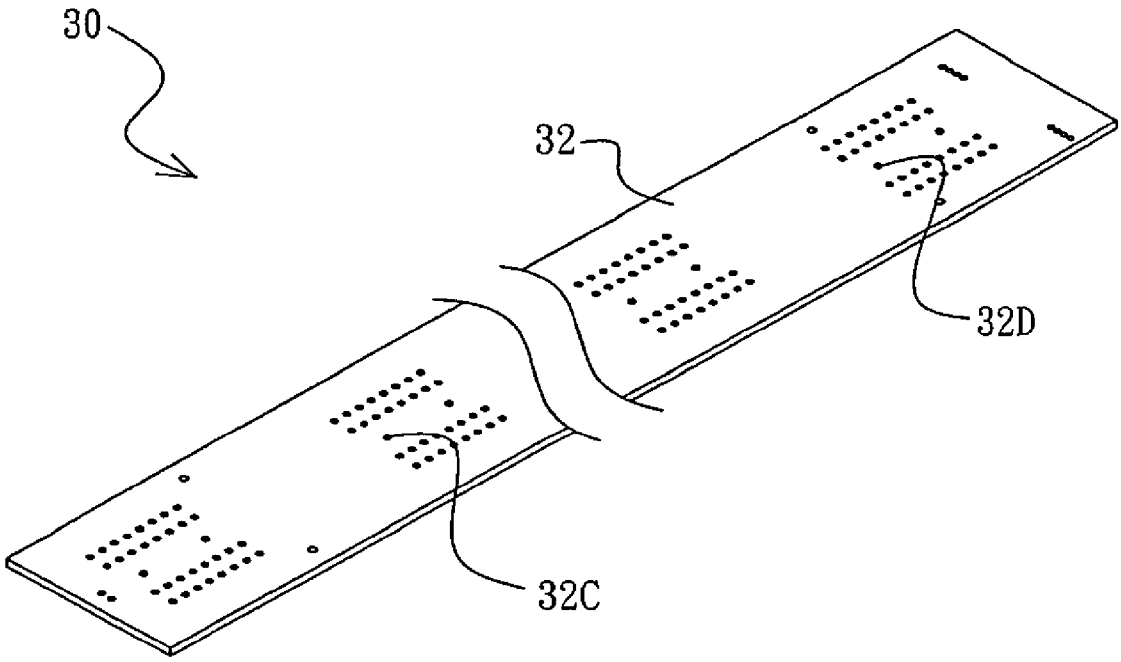
FIG. 10 is a perspective view, taken from the back side, of the lamp assembly carrier board of said yet a further different type.

Or alternatively, as shown in FIG. 9, the lamp assembly carrier board 30 can comprise a plurality of light-emitting diode circuit modules 37, 38, 39, a parallel-connection wiring board 32 that clamps and retains the light-emitting diode circuit modules 37, 38, 39 thereon, and a heat dissipation board, which physically engages a back side of the parallel-connection wiring board 32, stacked over and bonded to each other. (It is noted that the heat dissipation board is not shown in FIG. 9, but can be one that is similar to the heat dissipation board 33 discussed previously.) Arranged on locations of the parallel-connection wiring board 32 corresponding to opposite sides of each light-emitting diode circuit module 37, 38, 39 are resilient clips 32A, 32B that clamp on opposite side walls of the light-emitting diode circuit module 37, 38, 39. As shown, the clips 32A are clips in the form of resilient pressing plates for vertically pressing and thus retaining a light-emitting diode circuit module 37 having horizontal bottom board; or alternatively, the clips 32B can be U-shaped clips with a top opening for receiving and clamping a light-emitting diode circuit module 38, 39 having horizontal bars extending from opposite sides thereof. These resilient clips 32A, 32B, as shown in FIG. 10, are fixed to corresponding positions on the parallel-connection wiring board 32 by rivets 32C, 32D to be connected to and integrated to the parallel-connection wiring board 32.

It can be seen from the above description that the ceiling light fixture constructed in accordance with the present invention can be adapted to various lamp assembly whereby change of lamp assembly does not necessarily lead to replacement of new light fixture. Consequently, discarding of the light fixture in replacing with newly developed lamp assembly is no longer necessary, and conservation of nature resources can be realized. Although the present invention has been described with reference to the preferred embodiment thereof, it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ceiling light fixture adapted to interchangeably use various lamp assemblies, comprising:

a rectangular base housing forming at least one elongated channel having a trapezoidal cross section, said channel having a bottom wall forming an elongate slot, said bottom wall of said channel forming on a back side thereof a circumferential raised mounting frame and a plurality of barbs extending from said mounting frame, said bottom wall of said channel being provided in each lengthwise end with respect to said elongate slot with a lamp tube end seat fitting hole;

a light-transmitting cover panel corresponding to said elongated channel, said cover panel having edge plates forming tenon fitting structures for closing an opening of said elongated channel; and a lamp assembly carrier board removably received in said mounting frame and clamped and secured by said barbs to have a light source exposed through said elongate slot for irradiating light toward side walls of said channel, said lamp assembly carrier board comprising a wiring board having a surface forming bores for respectively receiving and fixing therein a plurality of twisting type sockets in a rotatably fitting manner, light-source and rectification circuit board assemblies having the same number as said twisting type sockets and each being a T-shape formed by fitting and soldering separate vertical and horizontal plates together, and a heat dissipation board forming therein coolant passages and comprising a plurality of heat dissipation fins arranged on a back thereof, which are stacked together; wherein each of said light-source and rectification circuit board assemblies is provided on a tip of said vertical plate thereof with electrical conduction faces corresponding to electrical contacts of and fitting into said twisting type sockets and is provided, on said horizontal plate that is exposed outside said twisting type sockets, with a light-emitting diode to serve as the light source, and wherein the heat dissipation board has opposite flanges extending laterally and positioned on said wiring board and clamped and secured by said barbs;

wherein the ceiling light fixture selectively allows a lamp tube end seat to be fit and retained in the lamp tube end seat fitting hole to set and fix a lamp tube of a second lamp assembly below the elongate slot to realize interchangeable use of the ceiling light fixture with different lamp assemblies.

2. The ceiling light fixture as claimed in claim 1, wherein said tenon fitting structures formed on said edge plates of the light-transmitting cover panel comprise outside-barbed retention bars formed on said edge plates of said cover panel at locations vertically corresponding to fitting holes formed in a connection wall arranged between the opening of two of said channel that are adjacent to each other in order to fit into the fitting holes to thereby have the cover panel retained on and covering said openings of said channel.

3. The ceiling light fixture as claimed in claim 1, wherein the cover panel forms on a surface thereof at locations close to and spaced from side edges thereof a predetermined distance through holes and wherein the opening of the channel has side lips which forms locking holes corresponding in locations to the through holes of the cover panel.

4. The ceiling light fixture as claimed in claim 1, wherein the cover panel has a surface facing the trapezoidal-cross-section channel and having opposite edge sections forming straight light-splitting racks, the surface having a central major area forming inward-concaved light-deflecting grid cells and wherein the trapezoidal-cross-section elongated channel has opposite sloped side walls each forming light-reflecting grid cells that are convex inward.

* * * * *